US009211476B2

(12) United States Patent
Curry, Sr.

(10) Patent No.: US 9,211,476 B2
(45) Date of Patent: Dec. 15, 2015

(54) INTERACTIVE RIDING TOY WITH REALISTIC ANIMAL SOUNDS

(71) Applicant: John L. Curry, Sr., Shiloh, IL (US)

(72) Inventor: John L. Curry, Sr., Shiloh, IL (US)

( * ) Notice: Subject to any disclaimer, the term of this patent is extended or adjusted under 35 U.S.C. 154(b) by 0 days.

(21) Appl. No.: 14/040,128

(22) Filed: Sep. 27, 2013

(65) Prior Publication Data

US 2015/0093955 A1 Apr. 2, 2015

(51) Int. Cl.
*A63H 33/00* (2006.01)
*A63G 19/00* (2006.01)

(52) U.S. Cl.
CPC ..... *A63G 19/00* (2013.01)

(58) Field of Classification Search
USPC ..... 446/26, 28, 29, 313; 434/247; 472/95, 472/98–102, 133
See application file for complete search history.

(56) References Cited

U.S. PATENT DOCUMENTS

| | | | | |
|---|---|---|---|---|
| 2,659,600 | A | 11/1953 | Becker | |
| 2,707,102 | A | 4/1955 | Wendt | |
| 3,224,762 | A | 12/1965 | Strader | |
| 3,920,239 | A | 11/1975 | White | |
| 4,333,642 | A | 6/1982 | Adams | |
| 4,608,811 | A | 9/1986 | Echeverri | |
| 4,848,067 | A * | 7/1989 | Martinsen | 54/44.2 |
| 5,000,712 | A * | 3/1991 | Curry, Sr. | 446/26 |
| 5,387,108 | A | 2/1995 | Crowell | |
| 5,421,763 | A * | 6/1995 | Amburgey et al. | 446/194 |
| 5,425,078 | A | 6/1995 | Stern et al. | |
| 5,429,515 | A * | 7/1995 | Greenwood | 434/247 |
| 5,490,206 | A | 2/1996 | Stern et al. | |
| 5,570,414 | A | 10/1996 | Stern et al. | |
| 6,000,987 | A * | 12/1999 | Belin et al. | 446/175 |
| 6,109,196 | A | 8/2000 | Silber | |
| 6,150,947 | A * | 11/2000 | Shima | 340/692 |
| 6,210,167 | B1 * | 4/2001 | Nishiyama | 434/247 |
| 6,881,118 | B2 | 4/2005 | Klick, Jr. | |
| 7,300,328 | B2 | 11/2007 | Klick, Jr. | |
| 7,775,893 | B2 * | 8/2010 | Blumenthal | 472/95 |
| 8,246,479 | B2 * | 8/2012 | Tirelli | 472/96 |
| 8,529,310 | B2 * | 9/2013 | Powers et al. | 446/29 |
| 2005/0181699 | A1 | 8/2005 | Klick, Jr. | |
| 2007/0287139 | A1 * | 12/2007 | Holm | 434/247 |
| 2008/0090669 | A1 * | 4/2008 | Sonner et al. | 472/135 |
| 2013/0303045 | A1 * | 11/2013 | Monacelli | 446/29 |

* cited by examiner

*Primary Examiner* — Kurt Fernstrom
(74) *Attorney, Agent, or Firm* — Husch Blackwell LLP; Samuel Digirolamo

(57) ABSTRACT

A child's interactive riding toy fashioned to simulate the appearance of an animal or other character such as a horse and including electronics for producing realistic animal sounds under certain conditions to enhance the riding experience and to improve the interaction between the child and an adult. The present toy is either attachable to the upper leg portion of a person to simulate the riding experience or it can be ridden or played with by a child when the toy is resting on a supporting surface.

19 Claims, 4 Drawing Sheets

INTERACTIVE RIDING TOY WITH REALISTIC ANIMAL SOUNDS

The present invention relates generally to a riding type toy and, more particularly, to a toy specifically designed for interaction with an adult wherein the present toy can be either positioned on and secured to the leg of an adult, or it can be played with and ridden by a child by simply placing the toy on a supporting surface. The present toy is shaped and configured so as to resemble a riding type animal and includes an electronic control system for producing realistic animal sounds under certain riding conditions as will be hereinafter further explained. For realistic simulation and effect, the head and neck portion of the present toy, as well as the body portion, are coupled to an accelerometer and other electronic/audio means for producing realistic walking, trotting, cantering and galloping sounds and for producing various neighing sounds depending upon the rate of bounce or up and down movement of the child on the toy and based upon the amount of head movement.

BACKGROUND OF INVENTION

Different kinds of toys in which a horse, pony or various other animal forms and characters are reproduced for use by children to simulate the riding of such animals, such as horseback riding, are well known in the art. See, for example, U.S. Pat. Nos. 4,333,642; 3,920,239; 3,224,762; 2,707,102 and 2,659,600. None of these prior art devices are readily adaptable for constructive interaction with an adult.

Riding toys that provide interaction with an adult are also known in the art. See, for example, Echeverri U.S. Pat. No. 4,608,811 which discloses a miniaturized toy saddle shaped to hold and carry a young child, the saddle being specifically designed to be strapped onto the back of an adult while such adult crawls or otherwise moves across the floor or ground. An obvious limitation associated with the Echeverri toy is that if the child is positioned on the adult's back, there is no face-to face contact between adult and child. Without face-to-face contact, or at least having the child positioned in front of the adult, the adult is not able to effectively take part in the child's play. Additionally, the physical stress and general undesirableness of crawling on one's hands and knees likewise serves to shorten the period of play and interaction between adult and child.

Another toy providing adult interaction and play riding capability is the Knee Rider toy device made by the Danoco Corporation. The Danoco device includes a stuffed animal head portion resembling a horse's head having a fabric portion attached thereto adapted to rest upon and fit over the upper leg and knee portion of an adult. The fabric portion of the Danoco device has no definite body structure associated therewith, but instead, is merely a single or, at most, a few layers of relatively thin fabric material which is sized and cut to cover the upper leg and knee of an adult when opened and placed in a covering relationship thereon. The leg covering portion of the Danoco device has no structural cushioning or padding means associated therewith for supporting a child positioned thereon, and it provides no support for the head and neck portion of the toy associated therewith. The Danoco device has several shortcomings which limit its desirableness and usefulness as an interactive toy as more fully explained in U.S. Pat. No. 5,000,712.

See, also, Applicant's U.S. Pat. No. 5,000,712 which discloses a child's riding toy fashioned to simulate the appearance of an animal or other character and which allows face-to-face interaction with an adult. This toy is attachable to the upper leg portion of a person and includes a body member conformable to the upper leg portion of a person when attached thereto. The upper surface of the body member includes a seat or saddle-like shaped area associated therewith adapted to receive the posterior of a child when seated thereon, and a strap arrangement associated with the bottom portion of the boy member for attaching the toy to the upper leg portion of a person. The strap arrangement is adjustable to accommodate attachment to leg portions having different circumferential dimensions. When fashioned to simulate the appearance of a horse, this toy may also include a bridle assembly with reins, stirrups extending from opposite sides of the body member for accommodating the feet of a child positioned thereon, and a saddle blanket which overlays and overhangs the opposite sides of the leg upon which it is positioned.

None of the known prior art interactive riding toys include electronic means to further simulate the realistic sounds of the animal in a walking or running state.

For these and other reasons, the above disclosed known prior art devices can be improved to further enhance the child's riding experience, provide educational opportunities and further enhance the interactive experience.

SUMMARY OF INVENTION

The present toy construction overcomes many of the above discussed disadvantages and shortcomings associated with the known prior art devices including the toy constructions disclosed in the above-named patents and teaches the construction and operation of a novel fantasy developing child/adult interaction toy which is fashioned to simulate the appearance of a riding type animal and includes an electronic control system for realistically simulating the sounds of the animal during the walking, riding and galloping phases, as well as other sounds and recordings which will enhance both the riding and interactive experience and will also allow educational opportunities as well. The present toy animal is both (1) attachable to the upper portion of a person's leg in such a manner that a child may simulate riding the toy animal through the reciprocating movement of the person's leg and interact face-to-face with such person and (2) restable on a supporting surface such as a floor surface in such a manner that riding the toy animal may be simulated by the bouncing effect of the child on the toy animal. In this regard, the present toy has a substantial body structure having upper and lower portions, the entire body portion being made of a compressible, resilient and/or flexible type material providing ample cushioning between the rider, the wearer and/or the supporting surface and providing ample space for housing the associated electronics.

The upper portion of the body structure is shaped generally similar to the back of an animal such as a horse or pony and includes a rear portion extending slightly upwardly relative to a more slender middle section, the middle and rear portions forming a seat or saddle-like portion on which the child sits while straddling the more slender or tapered middle section. The underside portion of the body is likewise made of a compressible, resilient and/or flexible material or other structure so as to be easily biasable to conform to a person's leg when positioned thereagainst. Adjustable strap means are associated with the underside portion of the body member and are positioned so as to extend around the leg of a person utilizing the present toy to hold, support and securely fasten the toy in proper position on such person's leg. The design of the strap arrangement greatly facilitates the use with which an interacting adult can attach the present toy to one's leg and, in conjunction with the soft, compressible construction of the body member, it greatly enhances the comfort of the user to which the toy is attached. The straps are also removable from the body portion to accommodate resting the present toy animal on a supporting surface.

In addition, the body portion of the present toy is constructed such that the toy may be positioned facing toward or away from the interacting adult. The head and neck portions are preferably formed integral with and extend outwardly from the body member and are likewise preferably made of a similar resilient, compressible type material so as to be somewhat movable and pliable relative to the body portion. In this regard, the head and neck portions may include a mane fabricated of fibrous strands of material and appropriate facial features depending upon the particular animal form after which the toy is fashioned and the head and neck portions may be constructed so as to be somewhat pliable and movable thereby allowing some degree of manipulation to simulate head and neck movement. The present toy may include reins associated with a bridle or harness positioned over the head portion of the toy which may be pulled upon for urging head and neck movement. In this regard, movement of the head portion of the animal is coupled to an electronic control system for producing a neighing sound when appropriate. Also, the present toy may include a pair of optional stirrups extending from opposite sides of the body portion adjacent the seat area for engagement with the child's feet to further simulate the actual riding of the animal and it may include a handle member located near the base of the neck which may be grasped by the child to help hold and stabilize the child in proper position on the toy during use thereof.

In use, a child sitting on the body portion of the present toy may grasp the reins and place his/her feet in the optional stirrups to simulate sitting on and riding the animal. The resilient, yieldable nature of the head and neck portions of the present toy allows a child to manipulate the head and neck to some degree by pulling on the reins. Additionally, the person upon whose leg the present toy is positioned and secured can move their leg in a reciprocating up and down motion so as to simulate the upward and downward movement associated with the gallop of a horse or other animal while riding. In this regard, the electronic control system associated with the present toy animal includes at least an accelerometer, processing means, an audio system with speakers, and associated memory for realistically simulating the sounds of the animal during the riding experience. The accelerometer and associated electronics are housed within the body portion of the toy animal and the accelerometer is positioned and located so as to monitor and sense both the rate of reciprocating up and down motion of the body portion as well as movement of the neck and/or head portion of the animal. In this regard, the processing unit is programmed to receive the accelerometer data during a certain time period and depending upon the rate of reciprocating movement or the number of bounces of the body portion within a specific time period, the processing unit will instruct the audio system to play either a walking sound, a trotting sound, a cantering sound or various galloping sounds depending upon the number of bounces sensed during the particular time period. In similar fashion, the accelerometer will also monitor and sense movement or pitch changes associated with the neck and/or head portion of the animal and when it detects, for example, a sharp pitch change associated with pulling back on the reins of the animal, the accelerometer will output data regarding such movement to the processing unit. The processing unit, based upon this head and/or neck movement, will then instruct the audio system to play a neighing sound. Other appropriate sounds and/or recordings can likewise be used to enhance the overall riding experience.

In the imaginative eyes of a child, some simulated movement of the head and neck, however limited, as well as the walking, trotting, cantering, galloping and/or neighing sounds, impart action, spirit and realism to the present toy comparable to that of a real horse or other animal, particularly when the child and toy are bounced up and down in a gallop type fashion on the adult's leg. This helps to promote a close association and interaction between the child and the person upon whose leg the toy is attached. An adult can therefore use the present toy to meaningfully interact with a very young child or toddler so as to develop the important mental and imaginative skills of the child. This particular combination of features fosters the relationship between adult and child and makes the time spent together using the present toy an enjoyable learning experience helpful to forming the important parent/child bonds necessary for optimal child development. Educational messages, nursery rhymes, music, recorded messages, bible stories and other selectable features can also be incorporated into the toy animal as will be hereinafter explained.

Although it is recognized that the present toy can be made to simulate a wide variety of different types of animals such as a horse, donkey, giraffe, camel, zebra, elephant, swan, turtle, dinosaur, whale, dolphin, shark, or other farm and zoo animal characters, a toy fashioned to simulate the appearance of a pony will be described hereinafter for ease of discussion and explanation. Regardless of the animal character selected, the contoured back portion adapted for receiving the posterior of a small child, the resilient and compressible nature of the underside portion of the body enabling the present toy to easily and comfortably conform to the shape of a person's leg when fastened thereto, and the realistic animal sounds triggered during certain simulated animal movements are of special importance to the present invention. It is also anticipated that other possible applications of some portions of the present device may likewise include cartoon shaped characters, airplanes, space ships, and other similar forms although such devices may lack the same head and neck portions which typify most animals.

These and other objects and advantages of the present invention will become apparent to those skilled in the art after considering the following detailed specification in conjunction with the accompanying drawings.

BRIEF DESCRIPTION OF THE DRAWINGS

For a better understanding of the present invention, reference may be made to the accompanying drawings.

DETAILED DESCRIPTION

Figure 1:
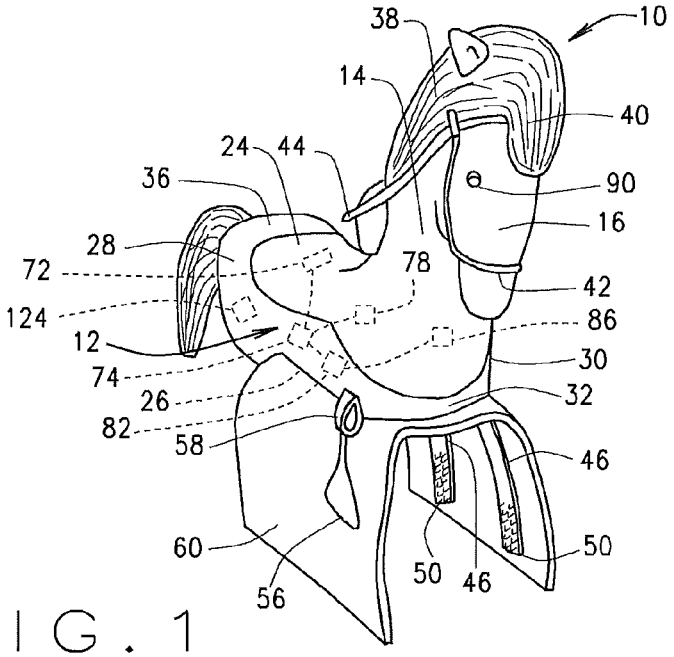
FIG. 1 is a perspective view of a riding toy constructed according to the teachings of the present invention.
Figure 2:
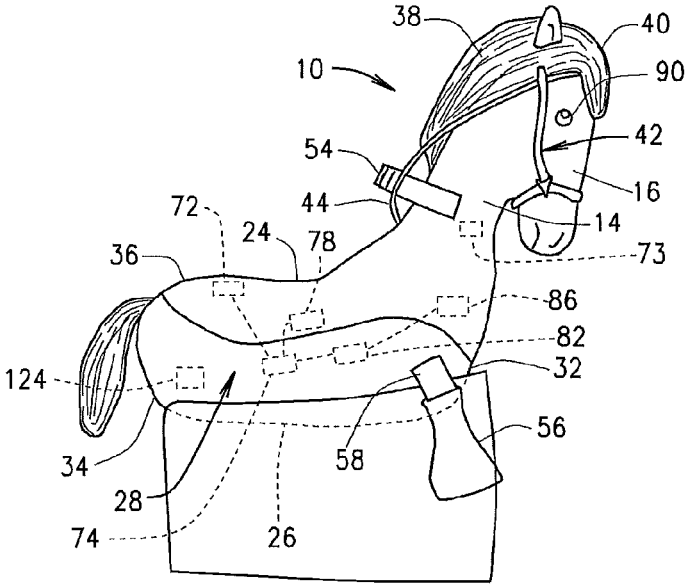
FIG. 2 is a side elevational view of the toy of FIG. 1.
Figure 3:
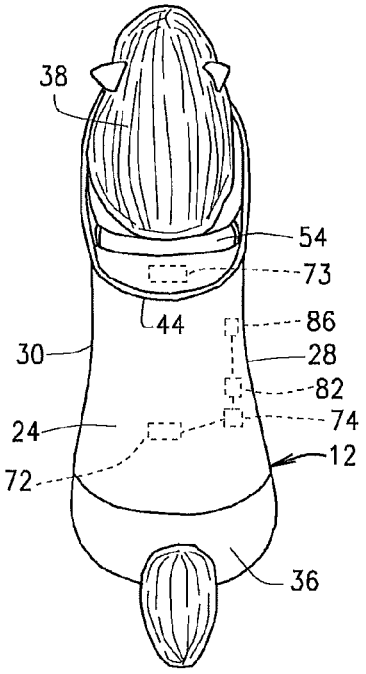
FIG. 3 is a top plan view of the toy of FIG. 1.

Referring to the drawings more particularly by reference numbers wherein like numerals refer to like parts, number 10 in FIG. 1 identifies one embodiment of an interactive riding toy constructed according to the teachings of the present invention. The present toy 10 is a three-dimensional representation of a portion of an animal such as a horse and its main body features are substantially similar to the features disclosed in Applicant's U.S. Pat. No. 5,000,712, all of which disclosure is incorporated herein by reference. In this respect, the present toy 10 includes a body portion 12, a neck portion 14, and a head portion 16, the toy 10 being shown in FIG. 5 in operative position on the horizontally extended upper leg portion 18 of an adult or other person 20, with a child 22 seated thereon in riding position. The body, neck and head portions 12, 14 and 16 are preferably integrally formed into a one-piece construction and fashioned so as to resemble the particular shape of the animal desired, although other constructions are likewise recognized such as having each portion 12, 14 and 16 separately formed and operatively attached to each other by suitable means. The body portion 12 is generally elongated in structure and includes spaced apart upper and lower portions 24 and 26 respectively as best shown in FIGS. 1 and 2, spaced apart side portions 28 and 30 as best shown in FIGS. 1 and 3, and spaced apart end portions 32 and 34 as best shown in FIG. 2. The body 12 is made of or stuffed with a soft, compressible, resilient type material such as a soft foam rubber type material, a fluffed fibrous type material, or any other similar type compressible, resilient and/or flexible material having a soft fabric cloth material covering the entire outer portion thereof and further includes space therein for the electronic components of one embodiment of the present control system 70 as best identified in FIG. 6. The compressible, resilient type material fills the entire space or cavity formed by and between the peripheral body side portions 24-34 and around the electronic control system 70 and such material is of sufficient quantity to provide ample cushioning or padding means between the rider of the toy and the person's leg upon which the device rests. This is more clearly illustrated in FIG. 5.

Figure 5:
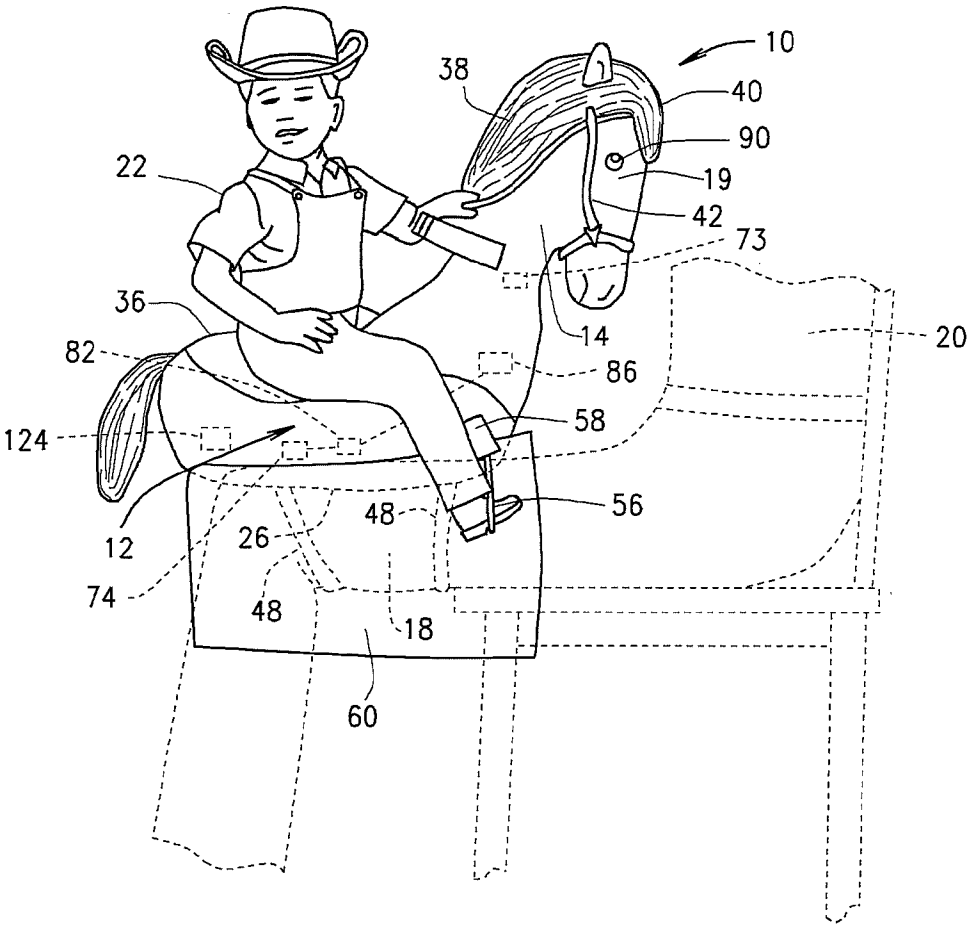
FIG. 5 is a side elevational view similar to FIG. 2 showing the present toy in operative position on the leg of an adult.

The upper portion 24 of the body 12 is shaped generally similar to the back of the particular animal after which the present toy is fashioned such as the horse or pony depicted in FIGS. 1-5. The upper body portion 24 includes a rear portion 36 which extends slightly upwardly relative to a more slender middle section as best shown in FIGS. 1-3, the middle and rear portions of the body 12 forming a seat or saddle like area on which a child may sit. When viewed from the top as best shown in FIG. 3, the upper back portion 24 of the body 12 has a form resembling the hourglass shape of a riding saddle, the spaced apart side portions 28 and 30 each including a concaved portion as best illustrated in FIG. 3. Also, when viewed from the side as best shown in FIG. 2, the front and rear portions of the upper back 24 taper inwardly toward the center of the body 12. This particular body configuration forms the seat or saddle portion adapted to receive the posterior of a child in such a position that the legs of the child straddle the more slender, concaved or tapered portions of the side walls 28 and 30 as shown in FIG. 5.

Since the compressible, resilient type material forming the body portion 12 extends to adjacent the lower portion 26, once positioned in operative position on a person's leg as illustrated in FIG. 5, the underside portion 26 is easily biasable and yieldable inwardly towards the center thereof when attached to a person's leg thereby substantially conforming the lower surface of the body 12 to the shape of the upper leg portion engaged therewith. Also, the underside portion 26 is likewise yieldable due to the weight of the child rider 22 positioned thereon. This yieldability and flexibility is important because this not only provides a certain degree of comfort to the person upon whose leg the toy 10 rests, but it also provides for a better and safer engagement with the leg thereby facilitating a more stable and secure positioning of the present toy 10 upon a user's leg. This greatly reduces the possibility or tendency of the present toy to slip or slide off of one's leg and provides a more stable platform for use as a riding toy. It is also important that the overall thickness of the body 12 be such that the inward compressibility or resiliency of the underside portion 26 will not substantially affect the overall shape of the upper back portion 24 and/or interface with the operation of the electronic control system 70 as will be hereinafter further explained. In this regard, although the overall thickness of the body 12 as measured from the upper back 24 to the underside portion 26 may vary depending upon the compressibility and resiliency of the material used, such thickness should be sufficient to likewise provide comfort for the child rider as well as the person upon whose leg the toy is positioned.

The neck and head portions 14 and 16 are preferably integrally formed with the body 12, the neck 14 extending upwardly and outwardly at an angular orientation from the forward end of the body as shown in FIGS. 1, 2, and 5. The neck 14 is of a modified frusto-conical shape having a somewhat elliptical cross-section which is generally similar to that of an actual pony. Although a one-piece construction is generally preferred, the head and neck portions can be fabricated or formed separately, or such portions can be integrally formed apart from the body portion 12. If this is the case, such head and neck portions can be assembled and connected together to the body 12 so as to appear as illustrated in FIGS. 1-5 using well known techniques. Although it is recognized that the head and neck portions 14 and 16 may be fabricated from a wide variety of suitable materials, it is preferred that the head and neck portions be likewise made of a compressible, resilient type material similar to that used to fabricate the body 12, particularly, if such portions are formed integral therewith. This enables the head and neck portions to be somewhat movable and pliable relative to the body 12 when a pulling or pushing force is exerted thereagainst. The resilient, yieldable nature of the head and neck portions therefore allows a child to manipulate the head and neck to some degree by pulling or pushing thereagainst, for example, by pulling on the reins 44 as will be hereinafter be explained. Since the neck 14 is yieldable when any external force applied thereagainst is removed, the elasticity associated therewith will cause the neck 14 to return to and assume it's predetermined at rest position as illustrated in FIGS. 1, 2, and 5. Although some degree of manipulation of the neck and head portions 14 and 16 to simulate the movement thereof is optional, such simulated movement, however limited, imparts additional action and realism to the present toy as will be hereinafter further explained comparable to that associated with the actual riding of a real horse or other animal.

In addition, the various parts of the present toy 10 can be decorated, colored and/or embroidered to produce as much realism as desired. For example, the head portion 16 may include a mane 38 fabricated of fibrous strands of material, a forelock 40 formed from a similar type material, and other appropriate facial features depending upon the particular animal form after which the present device is fashioned. Additionally, a bridle or harness assembly 42 may be positioned over the head portion 16 as best shown in FIGS. 1-5 to impart additional realism to the toy 10. The bridle assembly 42 includes suitable straps and head stall and reins 44 suitably attached thereto. A user, by manipulating the reins 44, can impart some movement to the head and neck in opposition to the natural resiliency or yieldability of the material forming such head and neck portion and such movement can trigger realistic simulated sounds for the toy animal as will be hereinafter further explained. The entire bridle assembly 42 including the reins 44 can be fabricated from known materials such as leather, canvas, fabric, plastic or other natural and/or synthetic materials. The exertion of a pulling force on the reins 44 controls the movement of the head and neck portions and activation of certain animal sounds as will be hereinafter explained In this regard, the relative elasticity or yieldability of the members 14 and 16 based upon the particular type of compressible, resilient type materials utilized to form the same will have a bearing on how much head and neck movement will be produced relative to the body 12. Once some head and neck movement is achieved, the operator need only let up on the reins 44 for the neck and head portions to return to their normal, at rest positions.

One or more selectively engageable, adjustable strap means such as the respective pairs of strap members 46 and 48 are positioned adjacent the underside portion of the body member 12 for securely fastening the present toy 10 to the upper leg portion of an adult. One end portion of each of the strap members 46 and 48 can be either fixedly attached or removably attached by suitable means to either the underside portion 26 or the opposite side portions 28 and 30 of the body 12, as desired. If removably attached to the body 12, the one end portion of each strap member 46 and 48 can be attached to the body portion via a multitude of different cooperatively engageable means such as synthetic materials which adhere when pressed together such as Velcro® fastener strips, a buckle, hook and eyelet arrangement, buttons, snap fasteners and so forth. Removing the strap members 46 and 48 from the body portion 12 facilitates use of the present toy 10 on a supporting surface when the toy 10 is not attached to the upper leg portion of an adult.

Figure 4:
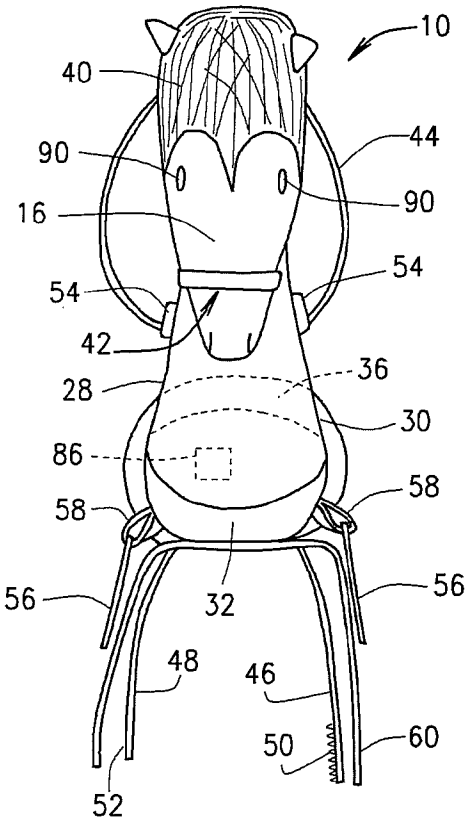
FIG. 4 is a front elevational view of the toy of FIG. 1.

Each respective pair of strap members 46 and 48 are also of sufficient length to wrap around or encircle an adult's leg in overlapping fashion and each such pair includes cooperatively engageable means associated with the respective free end portions thereof, such cooperatively engageable means enabling the strap members 46 and 48 to be adjustable to accommodate attachment to leg portions having different circumferential dimensions. In this regard, it is also recognized that a wide variety of cooperatively engageable means may be utilized in association with the connectable end portions of the strap members 46 and 48. For example, as illustrated in FIGS. 1 and 4, such cooperatively engageable means may include synthetic materials which adhere when pressed together such as the Velcro® fastener strips 50 and 52 (FIG. 4) applied adjacent to each free end portion of the members 46 and 48 in position so as to overlap each other to make the necessary connection. The overlapping of the connectable end portions 50 and 52 of the strap member 46 and 48 also will afford adjustability in attaching the toy 10 to the leg of a particular adult. Alternatively, the free end portion of one of the strap members 46 and 48 could be provided with a buckle and hook arrangement adapted to engage a desired one of a plurality of spaced eyelets located adjacent the free end portion of the other of the strap members 46 and 48, or the cooperatively engageable means 50 and 52 may include a plurality of snap fasteners or a button arrangement. Other known fastener means affording adjustability to the strap members 46 and 48 could likewise be utilized. It is also recognized and anticipated that, instead of utilizing respective pairs of cooperatively engageable strap members such as the members 46 and 48, such pairs of strap members may be respectively replaced by a single strap member having one end portion fixedly attached adjacent one side of the body portion 12 and having its free end portion cooperatively engageable with corresponding means associated with the opposite side thereof.

It is also important that the attachment means be adjustable in some fashion as previously explained and that such means provide sufficient force to prevent rotation about or disengagement from the leg of the person to which the toy 10 is attached. This is particularly important when one moves their leg in a reciprocating up and down motion to simulate the upward and downward movement associated with the gallop of a horse while riding. The selection of the strap material in conjunction with the compressible construction of the body member should afford comfort to the adult to which the toy is attached.

The present toy 10 may also optionally included a handle member 54 located near the base of the neck portion 14 as best shown in FIGS. 2 and 3. The handle 54 is a somewhat curved, cylindrical sectional member fixedly attached at both opposite ends thereof to the respective opposite sides of the neck 14 by any suitable means. The handle member 54 is sized so as to be comfortably and securely held in one or both hands by a small child for steadying and stabilizing the child in a proper position while sitting on the toy 10. This is particularly important if the child is bounced up and down in a gallop-type fashion on an adult's leg. Also, the toy 10 may include a pair of optional stirrups 56 extending from opposite sides of the body 12 adjacent the seat area for engagement with a child's feet and should be of sufficient size to receive a child's foot as illustrated in FIG. 5. The stirrups 56 may be attached to the body 12 by any suitable means such as looping one end portion of the stirrup 56 through a ring or loop member 58 which is fixedly secured to the body as best illustrated in FIGS. 1 and 2. Still further, the toy 10 may likewise include an optional saddle blanket 60 to further impart realism to the toy 10. The saddle blanket 60 may be attached by suitable means to the underside portion 26 of the body 12 as shown in FIGS. 1 and 4. When in position on a user's leg, the saddle blanket 60 overlays and overhangs the opposite side portions of the leg and completely conceals the strap members 46 and 48 from view. Additionally, for educational purposes or otherwise, the saddle blanket 60 may also include an arrangement of alpha-numeric figures, characters, designs or the like on the outside thereof.

It is also important to note that body portion 12 of the present toy 10 is specifically constructed such that the toy may be positioned on a person's leg in one of two possible orientations, namely, with the head portion 16 facing either toward or away from the interacting adult. This is true because the body portion 12 has no interfering structure which limits the manner in which it is positioned upon a user's leg. This therefore enables a user to position the toy 10 so that the child seated thereon will be in face-to-face contact with the adult user, if desired. This feature is likewise important because it promotes and fosters a close relationship and interaction between the child, the toy 10, and the interacting adult upon whose leg the toy is attached, all of which helps to form the important parent/child bonds necessary from optimal child development.

It is also recognized and anticipated that the present toy 10 can be played with and ridden by a child by simply positioning the body portion 12 on a substantially flat supporting surface such as the floor of a room or exterior surface. In this regard, the straps 46 and 48, if removably attachable to the body portion 12, can be removed from the present toy 10 as previously explained prior to positioning the toy 10 on the supporting surface. A child can then straddle the toy 10 and sit on the seat or saddle-like area associated with the upper body portion 12 as previously explained. An adult can still interact with the child even in this particular mode of operation by monitoring the child's behavior and activity while seated on the present toy and the adult can further interact with the child during the child's riding experience. In this regard, the riding experience is achieved by having the child simply bounce up and down on the body portion 12 to simulate the up and down movement associated with the gallop of a horse or pony, or other animal. Other simulations are also recognized and anticipated.

Figure 6:
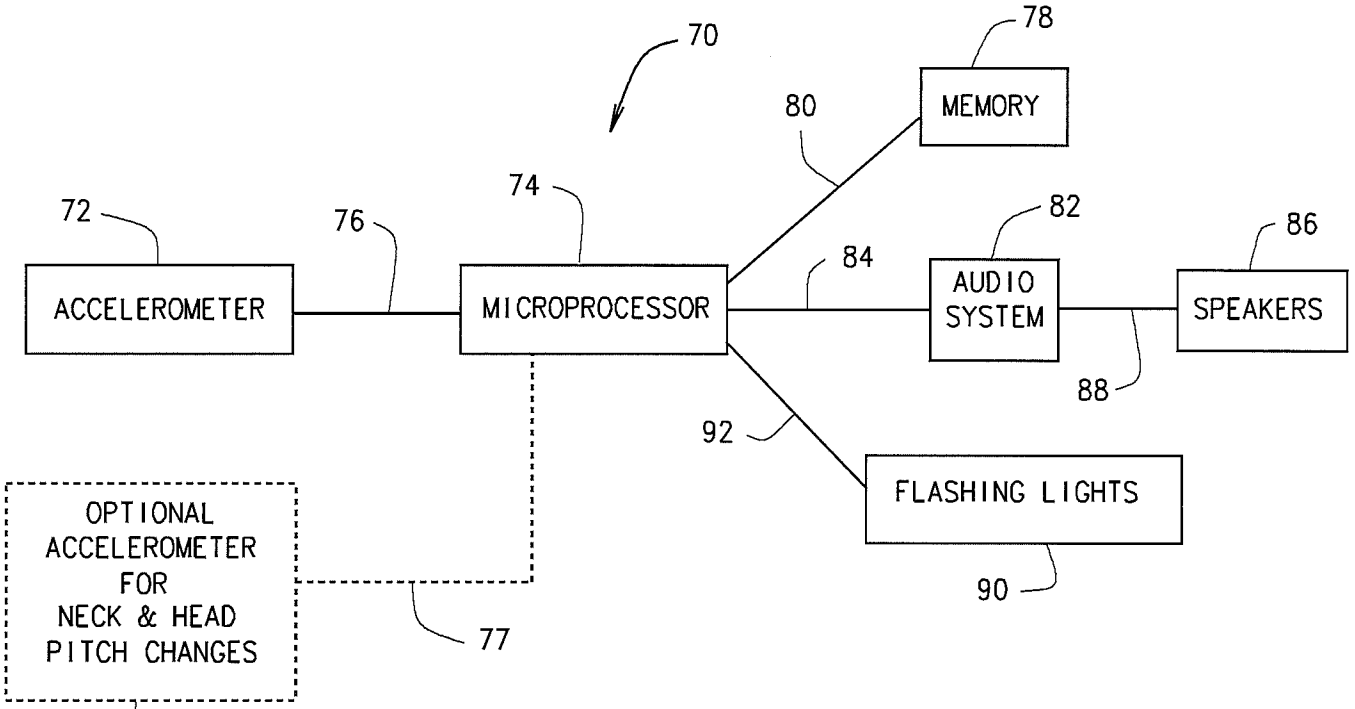
FIG. 6 is a schematic diagram of one embodiment of an electronic system constructed in accordance with the teachings of the present invention.

Referring to FIG. 6, numeral 70 in FIG. 6 represents one embodiment of the present electronic control system for providing realistic animal sounds under certain riding conditions to enhance both the riding and interactive experience between the child and adult. The electronic control system 70 is one embodiment of a control system for analyzing certain movements of the present toy 10 during the riding experience and thereafter selecting an appropriate animal sound which corresponds to that particular riding experience. The control system 70 includes at least one accelerometer 72 which can be positioned and located in the body portion 12 either in the vicinity of upper body portion 24 forming the seat or saddle-like area on which a child may sit, or in the vicinity of the lower body portion 26 which will rest upon a person's leg or a supporting surface as previously explained. The accelerometer 72 is a standard three axis accelerometer known in the art and is coupled or linked to a microprocessor or electronic control module 74 via conductive path 76. The accelerometer 72 is preferably capable of sensing at least the rate of vertical movement or displacement of the body portion 12 within a certain predetermined period of time, and is likewise preferably capable of sensing movement of the head and/or neck portions 14 and 16 and/or measuring changes in pitch associated with the head and/or neck portions of the present toy 10 as will be hereinafter further explained. The amount of vertical movement or displacement of the body portion 12 due to the reciprocating motion or bouncing of a child on such body portion within a predetermined time period will be sensed by the accelerometer 72 and such accelerometer data will be monitored and received by the microprocessor 74. Once microprocessor 74 receives the appropriate accelerometer data from accelerometer 72, it will search and retrieve from a memory 78 which is in communication with microprocessor 74 the appropriate animal sound corresponding to the accelerometer data previously received via conductive path 80 and will then output an appropriate signal to the audio system 82 via conductive path 84 so as to play the appropriate simulated realistic sound of the animal based upon that particular activity. Speakers 86 are likewise linked and/or coupled to the audio system 82 via conductive path 88 and serve to broadcast the appropriate animal sound. Speakers 86 can be interval with and/or incorporated into audio system 82 or one or more speakers can be separate and apart from the audio system 82 as illustrated in FIG. 6.

It is recognized that microprocessor 74 can be programmed to monitor and sense the amount of vertical movement or vertical displacement of the body portion 12 on the upper leg portion of an adult, or on a supporting surface, due to the reciprocating up and down motion or bounce produced by either the adult or the child within a certain predetermined time period so as to simulate the upward and downward movement associated with the gallop of a horse or other movement of an animal while riding. As explained, the accelerometer 72 will monitor and sense the rate of vertical displacement and will output data regarding the same via conductive path 76 to microprocessor 74. Microprocessor 74, based upon this movement, will select the appropriate animal sound from memory 78 and will then output an appropriate signal to the audio system 82.

The accelerometer 72 is likewise tied, linked or coupled to the neck and/or head portions 14 and 16 of the present toy so as to monitor and sense movement or displacement of the head and/or neck portions of the toy when a pulling or pushing force is exerted thereagainst. In this particular aspect of the present invention, the accelerometer 72 will sense any pitch movement relative to the head and/or neck portions 14 and 16 when a pulling force is exerted thereagainst, for example, by manipulating the reins 44 so as to impart movement thereto. This pitch movement of the head and/or neck portions 14 and 16 is transmitted to the body portion 12 and a corresponding pitch change will likewise occur with respect to body portion 12. The pitch change associated with body portion 12 will be monitored and sensed by accelerometer 72 and such accelerometer data will be received by the microprocessor 74. The resilient, yieldable nature of the head and neck portions allows a child to manipulate such portions to some degree by pulling or pushing thereagainst, for example, by pulling on the reins 44 as previously explained to impart some realism to the riding experience. Here again, accelerometer 72 monitors and senses this pitch displacement which is transmitted through the body portion 12 and outputs data with respect to the same via conductive path 76 to microprocessor 74. Microprocessor 74 retrieves the appropriate simulated realistic sound of the animal based upon this particular activity from memory 78 and thereafter outputs an appropriate signal via conductive path 84 to the audio system 82 to play the retrieved audio sound such as a neighing sound or other appropriate animal sound.

With respect to monitoring and sensing movement or displacement of the head and/or neck portions 14 and 16 of the present toy 10, it is also recognized and anticipated that an optional second accelerometer 73 can be positioned and located in the vicinity of the neck and/or head portions 14 and 16 so as to separately monitor and sense movement or displacement of the head and/or neck portions of the present toy separate and apart from any pitch changes associated with the body portion 12. This optional accelerometer 73 could likewise be coupled or linked to the microprocessor 74 via conductive path 77 as illustrated in FIG. 6. In this particular embodiment, accelerometer 72 would monitor and sense the rate of vertical movement or displacement of the body portion 12 whereas the optional accelerometer 73 would monitor and sense the movement or pitch displacement associated with the neck and/or head portions 14 and 16. In all other respects, the control system 70 would operate and function as previously explained and would retrieve from memory 78 the appropriate neighing sound or other appropriate animal sound based upon the data received from accelerometer 73.

The electronic control system 70 may also include flashing lights 90 which are likewise linked or coupled to microprocessor 74 via conductive path 92. The flashing lights could be associated with the eyes of the animal or any plurality of lights could be disbursed on the toy 10 depending upon the particular animal or character selected and such lights could be programmed to flash through microprocessor 74 any time a simulated realistic sound of the animal is transmitted through speakers 86.

It is also recognized and anticipated that memory 78 can be separate and apart from microprocessor 74, or memory 78 can be incorporated therewithin in a conventional manner. Similarly, the audio system 82 may be integral with microprocessor 74.

The entire electronic control system 70 can be incorporated into the body portion 12 of the toy 10 as best illustrated in FIGS. 1-3. In this regard, it is recognized and anticipated that the electronic control system 70 can be incorporated into body portion 12 in a wide variety of different arrangements and the various components associated with system 70 can be housed substantially together in a particular location or separately within the body portion 12 and/or the head and neck portions 14 and 16 depending upon the particular shape of the body portion associated with the particular animal or other character being simulated by the toy 10. As illustrated in FIGS. 1-3, the accelerometer 72, microprocessor 74, audio system 82, speakers 86 and flashing lights 90 are positioned and located within body portion 12 in one embodiment of such arrangement.

Figure 7:
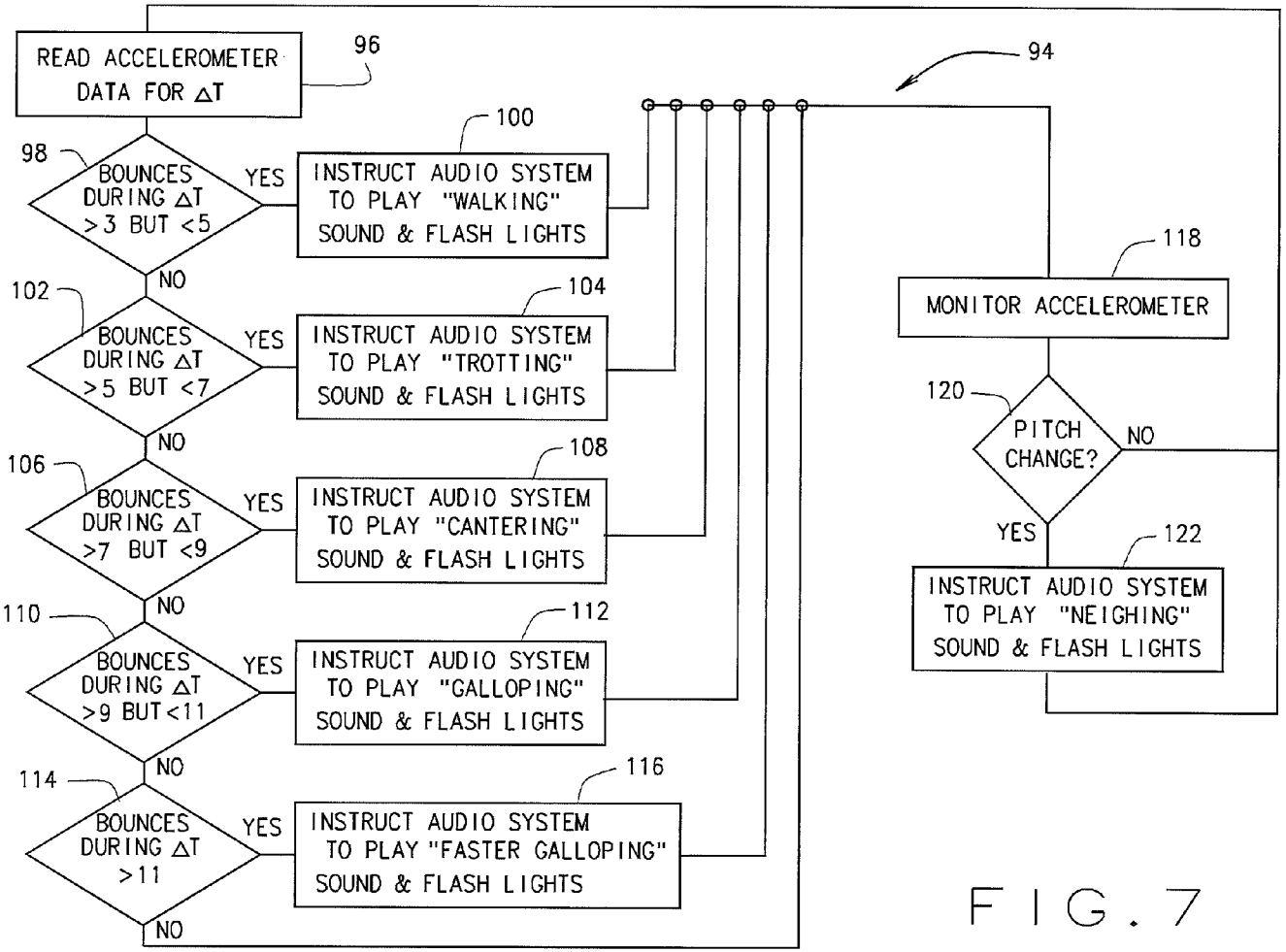
FIG. 7 is a flow chart of operating steps for one embodiment of the present electronic system constructed in accordance with the teachings of the present invention.

An example of operation of the present electronic control system 70 in accordance with one aspect of the present invention is set forth in the flow chart 94 illustrated in FIG. 7. The operating steps in control loop 94 can be incorporated into the programming of the processing means of microprocessor 74 by techniques well known to those of ordinary skill in the art. Based upon flow chart 94, the microprocessor 74 is programmed to monitor and read accelerometer data for a certain predetermined period of time (ΔT) at step 96. More particularly, microprocessor 74 will receive inputs from accelerometer 72 via conductive path 76 relative to the vertical displacement or bounce rate of either the child bouncing on the body portion 12 when it is positioned on a supporting surface, or the bounce rate of the upper leg portion of the interactive adult upon which the toy 10 is placed. Based upon the number of bounces recorded during the particular predetermined ΔT time period, the microprocessor 74 will retrieve from memory 78 via conductive path 80 the appropriate realistic animal sound associated with any one of steps 98, 102, 106, 110 and 114 as will be hereinafter explained and will then instruct the audio system 82 via conductive path 84 to play that particular animal sound, which sound will be communicated via speakers 86.

More particularly, once the accelerometer data for a particular ΔT time period is received by microprocessor 74, the microprocessor will determine at step 98 whether the number of bounces recorded during that particular ΔT time period falls within a predetermined range such as greater than 3 bounces but less than 5 bounces. If, at step 98, the number of bounces recorded during the predetermined time period is, in fact, greater than 3 but less than 5, the microprocessor 74 will retrieve from memory 78 the realistic animal sound associated with that particular number of bounces such as the "walking" sound and will output an appropriate signal to the audio system 82 to play the "walking" sound at step 100. Flashing lights 90 can also be associated with step 100 as will be hereinafter further explained.

If, at step 98, the microprocessor determines that the number of bounces recorded during the particular predetermined ΔT time period was not greater than 3 but less than 5, the microprocessor 74 will advance to step 102 and determine if the number of bounces recorded during the particular ΔT time period was greater than 5 and less than 7. If, at step 102, it is determined that the number of bounces recorded during the particular ΔT time period is, in fact, greater than 5 but less than 7, the microprocessor 74 will retrieve from memory 78 the realistic animal sound associated with that particular number of bounces such as the "trotting" sound and will output an appropriate signal to the audio system 82 to play the "trotting" sound at step 104. Flashing lights 90 can also be associated with step 104 as will be hereinafter further explained.

If, at step 102, the microprocessor 74 determines that the number of bounces recorded during that particular ΔT time period was not greater than 5 but less than 7, the microprocessor 74 will advance to step 106 and determine if the number of bounces recorded during that particular time period was greater than 7 but less than 9. If the microprocessor determines at step 106 that the number of bounces recorded during that particular ΔT time period was, in fact, greater than 7 but less than 9, the microprocessor 74 will retrieve from memory 78 the realistic animal sound associated with that particular number of bounces such as the "cantering" sound and will output an appropriate signal to the audio system 82 to play the "cantering" sound at step 108. Flashing lights 90 can also be associated with step 108 as will be hereinafter further explained.

If, at step 106, the microprocessor 74 determines that the number of bounces recorded during that particular time period was not greater than 7 but less than 9, the microprocessor will advance to step 110 and determine if the number of bounces recorded during that particular ΔT time period was greater than 9 but less than 11. If, at step 110, it is determined that the number of bounces recorded during the predetermined time period is, in fact, greater than 9 but less than 11, the microprocessor 74 will retrieve from memory 78 the realistic animal sound associated with that particular number of bounces such as the "galloping" sound and will output an appropriate signal to the audio system 82 to play the "galloping" sound at step 112. Flashing lights 90 can also be with step 112 as will be hereinafter further explained.

If, at step 110, the microprocessor 74 determines that the number of bounces recorded during that particular time period was not greater than 9 but less than 11, the microprocessor 74 will advance to the step 114 and determine if the number of bounces recorded during that particular ΔT time period was greater than 11. If, at step 114, the number of bounces recorded during the predetermined time period is, in fact, greater than 11, the microprocessor 74 will retrieve from memory 78 the realistic animal sound associated with that particular number of bounces such as the "faster galloping" sound and will output an appropriate signal to the audio system 82 to play the "faster galloping" sound at step 116. Flashing lights 90 can also be associated with step 116 as will be hereinafter further explained.

If, at step 114, the microprocessor 74 determines that the number of bounces recorded during that particular time period was not greater than 11, the microprocessor will advance to step 118 and continue to monitor the accelerometer for accelerometer data. In this regard, it should also be noted that at steps 100, 104, 108, 112 and 116, once the microprocessor 74 outputs an appropriate signal to the audio system to play the appropriate animal sound at these respective steps, the microprocessor will also advance to step 118 and continue to monitor the accelerometer for additional accelerometer data relating to pitch or movement of the neck and/or head portion of the toy. If, at step 118, the microprocessor 74 receives additional input from the accelerometer 72, or optional accelerometer 73, that a pitch change has occurred, the microprocessor, at step 120, will determine whether the input from the accelerometer 72 or 73 corresponds to a sharp pitch change associated with movement of the head and/or neck portions 14 and 16 of the present toy 10 such as by manipulating the reins 44 so as to impart movement thereto. If, at step 120, the microprocessor 72 determines that a sharp pitch change has occurred to the head and/or neck portions of the present toy, the microprocessor 74 will retrieve from memory 78 the realistic animal sound associated with that particular activity (pulling on the reins 74 to slow down the horse or other simulated animal or character) such as a "neighing" sound and will then output an appropriate signal to the audio system 82 to play the "neighing" sound or other appropriate sound at step 122. Flashing lights 90 can also be associated with step 122 as will be hereinafter further explained. After the completion of step 122, the microprocessor 74 returns to step 96 and control loop 94 is repeated.

If, on the other hand, at step 120, no sharp pitch change is detected from the accelerometer 72 or 73, then microprocessor 74 returns to step 96 and again repeats control loop 94.

In essence, the microprocessor or electronic controller 74 receives a signal from the accelerometer 72 indicative of the rate of vertical movement or rate of reciprocating motion of a child on the body member 12 within a predetermined period of time and then is further operable to output a signal to the audio system 82 to play a certain animal sound based upon the signal received from the accelerometer. In addition, the microprocessor 74 is also operable to receive a signal from either accelerometer 72, or optional accelerometer 73, indicative of the movement of the neck and/or head portion of the present toy and is further operable to output a signal to the audio system 82 to play a certain animal sound based upon the signal received from either accelerometer 72 or accelerometer 73. The electronic controller 74 will select an appropriate animal sound based upon either the rate of vertical movement of the body member 12 within said predetermined time period, or based upon the movement or pitch change of the neck and/or head portion of the present toy. Different animal sounds can be selected for different rates of vertical movement of the body member 12 within the selected predetermined time period.

It is also recognized and anticipated that the flashing lights 90 associated with the control system 70 can be activated by microprocessor 74 in conjunction with steps 100, 104, 108, 112, 116 and 122. It is also recognized and anticipated that the flashing lights 90 could be activated by microprocessor 74 separate and apart from steps 100, 104, 108, 112, 116 and 122, or in association with only some of such steps when the audio system 82 is instructed by the microprocessor 74 to play one, some or all of the various sounds associated with the simulated animal or other character. It is also recognized that other control system arrangements and other control loops are possible and are envisioned for instructing the audio system 82 to play a particular animal sound or to flash lights 90 associated with the present invention.

It is also recognized that all of the monitoring, sensing, decision making, activation, and instructing associated with all of the steps set forth in flow chart 94 will be equally applicable if the present toy 10 is positioned on a supporting surface and a child merely bounces up and down on body portion 12 and imparts movement of the head and neck portions 14 and 16 through the use of reins 44. The accelerometer 72, or optional accelerometer 73, will work substantially identical regardless of the mode of operation of the present toy 10.

Electronic controllers or modules such as microprocessor 74 are commonly used for accomplishing the various tasks associated with the present invention as illustrated in one embodiment thereof set forth in FIGS. 6 & 7. In this regard, microprocessor 74 will typically include processing means, such as a microcontroller or microprocessor, associated electronic circuitry such as input/output circuitry, analog circuit or programmed logic arrays, as well as associated memory. Microprocessors 74 can therefore be programmed to sense and recognize the appropriate signals indicative of the various conditions, states or actuations of the accelerometer 72 and optional accelerometer 73, and based upon such sensed conditions, microprocessor 74 will provide appropriate output signals to the audio system 82 to play the appropriate animal or character sound.

It is also recognized that variations to the operating steps depicted in flow chart 94 could likewise be made without departing from the spirit and scope of the present invention. In particular, steps could be added or some steps could be eliminated. All such variations are intended to be covered by the present invention. For example, the predetermined $\Delta T$ time period can be varied and changed depending upon the particular animal or other character simulated by the present toy 10, or the various bounce criteria identified in steps 98, 102, 106, 110 and 114 could likewise be varied and factors other than vertical movement of the body portion 12 or the bounce rate of body portion 12 could likewise be used as the accelerometer data for determining if a particular animal riding activity or other activity has been accomplished in order to generate a particular realistic animal sound. Similarly, something other than pitch change could be used as the accelerometer data to trigger a realistic animal sound based upon pulling on the reins or other activity. Still further, it is also recognized that a variety of other components such as switches, solenoids, relays, indicators, sensors and other control apparatus could be incorporated into the overall control system 70 depending upon the particular animal or other character simulated by the present toy.

In another aspect of the present invention, an electronic voice box or multi-purpose re-recordable, audible message delivery system 124 (FIG. 2) such as the message delivery system disclosed in U.S. Pat. No. 5,387,108, which disclosure is incorporated herein by reference, can likewise be incorporated into the present toy 10. The message delivery system 124 may include a housing within which is contained circuitry constructed for delivering a pre-recorded message when activated, while also enabling an individual to substitute a new message for the previously recorded message, when desired. As disclosed in U.S. Pat. No. 5,387,108, the circuitry associated with the message system 124 incorporates recording means which is capable of receiving and retaining an audible message, when activated into its record mode by associated switch means. In addition, when so activated, the circuitry is constructed for receiving and retaining the audibly enunciated message and overriding any message previously existing therein. The circuitry also incorporates activation switch means, separate and distinct from the recording switch means, which causes the circuit to deliver the message that has been previously recorded. When the circuit activation switch means is employed, the circuit automatically audibly delivers the last recorded message.

As disclosed in FIG. 2, the message delivery system 124 could be permanently housed within body portion 12 and/or head and neck portions 14 and 16 such that the activation switch means is easily accessible from the exterior of the toy 10. In this situation, the audible message recorded on the message delivery system 124 would be pre-recorded before inserted into the toy 10 during manufacture and construction. It is also recognized and anticipated that the message delivery system 124 could be removably housed within body portion 12 and/or head and neck portions 14 and 16 of the present toy 10 via a closable/openable pocket or other similar means having cooperatively engagement means associated therewith wherein the message delivery system 124 can be removed from such pocket for recording a new message and thereafter again repositioned within said pocket for additional use. Other similar re-recordable message delivery systems are likewise known and available.

Different types of audible messages can be recorded and re-recorded on message delivery system 124. For example, educational messages, music, bible stories, prayers, bedtime stories, personalized messages from parents, grandparents and other individuals, nursery rhymes, holiday greetings and the like can be recorded and re-recorded onto the message delivery system 124 at different times during the lifespan of the toy 10 so as to allow both the child and the interactive adult to use such audible messages during interactive play for child developmental purposes such as developing important mental and imaginative skills of the child, using such interactive time as a learning experience helpful to forming the important parent/child bond necessary for optimal child development and for basic educational purposes. In addition, the audible messages could be bi-lingual and recorded in both English and another language.

Still further, other voice message systems can likewise be used and incorporated into the present toy such as the voice message systems disclosed in U.S. Pat. Nos. 5,425,078; 5,490,206 and 5,570,414. These patents disclose a system for producing audible voice messages onto a message delivery system via a plurality of different communication links such as through the use of conventional telephone lines. These system enable an adult to create and selectively deliver a personalized voice message via the phone lines for recording onto a message delivery system such as system 124 prior to insertion into the interactive toy 10.

Still further, depending upon the appearance of the particular animal or other character selected for simulation by the present toy 10, a host of accessories for each animal and for each character can be produced and sold in conjunction therewith. For example, the present toy can be specialized for military individuals and their families, for cancer survivors, for alumni associated with universities, sororities and fraternities, and still other specialized groups. For example, camouflage outfits, dog tags and other military indicia can be produced and associated with the present toy when specialized for military personnel and their families. University logos, mascots, colors and other university indicia can be associated with alumni animals and characters. The same is likewise true for various fraternities and sororities. Sports mascots can also be replicated in accordance with the teachings of the present invention. Accessories can include carrying cases or bags for carrying and storing the present toy 10, various types of clothing for the animal or character and other accessories such as saddlebags, whips, ropes and other riding type accessories for use both on the animal or character as well as for use by the child riding the present toy 10. Still other uses, functions and accessories are anticipated and envisioned for use with the present toy 10.

To use the present toy 10, an adult user merely positions and secures the present toy 10 to his/her leg in one of the two possible orientations by securely fastening the strap members 46 and 48 therearound as illustrated in FIG. 5. A child sitting on the body portion 12 may then grasp the reins 44 and/or the handle member 54 and may thereafter place his/her feet in the optional stirrups 56 to simulate both sitting on and riding the toy 10. The rocking back and forth of the child on the toy 10 as well as bouncing the child and toy up and down on one's leg imparts realism to the riding experience. The yieldable nature of the neck and head portion 14 and 16 likewise enable a child to manipulate the head and neck to some degree by exerting a pulling force on the reins 44 thereby adding still further realism to the riding experience.

As previously explained, the various portions of the present toy 10 are preferably constructed of a soft, compressible, resilient type material such as foam rubber, a fluffed fibrous material, or any other such compressible and/or resilient material having a soft fabric cloth material covering the entire outer portion thereof. It is also anticipated that the present toy can be made from a wide variety of alternative materials such as a soft formable or moldable vinyl or plastic material or it may be made so as to be inflatable to provide the required compressibility and resiliency as previously explained. Likewise, it is anticipated that the present toy could be designed so as to proportionately match the confirmation of a wide variety of different animals and other characters including those previously mentioned above. Because there are many possibilities for varying designs and material usages that can be used in association with the present invention, those chosen and described above with reference to the embodiments disclosed herein are not intended to limit the present invention in any substantial manner.

Thus there has been shown and described a novel interactive riding toy construction which provides optimal interaction between child and adult, which construction fulfills all of the objects and advantages sought therefor. Many changes, modifications, variations and other uses and applications of the present invention will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A control system for providing sounds under certain conditions for a child's riding toy wherein the toy is a three-dimensional representation of a portion of an animal body upon which a child can be seated, the three-dimensional representation including a body member having opposed front and rear end portions, a middle portion located therebetween, spaced apart upper and lower portions, and a neck and head portion extending from the front end portion thereof said body member being both attachable to the upper portion of a person's leg and restable on a supporting surface, and at least the lower portion of said body member being made of a compressible, resilient material so as to conform to the shape of the upper portion of a person's leg, said control system comprising:

an accelerometer positioned and located within said body member, said accelerometer sensing the rate of vertical movement of said body member due to the reciprocating motion of a child on said body member within a predetermined period of time;

said accelerometer being further coupled to said neck portion for sensing any changes in pitch movement of said neck portion when a pulling force is exerted thereagainst;

memory for storing a plurality of different animal sounds;

an audio system for playing sound; and an electronic controller coupled to said accelerometer, to said memory, and to said audio system, said controller being operable to receive a signal from said accelerometer indicative of the rate of vertical movement of said body member within said predetermined period of time, said controller being further operable to output a signal to said memory to select an animal sound based upon the rate of vertical movement of said body member within said predetermined period of time different animal sounds bein selected for different rates of vertical movement within said predetermined period of time, and to output a signal to said audio system to play the selected animal sound based upon the signal received from said accelerometer; and said controller being further operable to receive a signal from said accelerometer indicative of any changes in pitch movement of said neck portion and to output a signal to said memory and to said audio system to select and play a certain animal sound based upon the signal received from said accelerometer.

2. The control system defined in claim 1 wherein said controller selects a "walking" sound based upon a first predetermined rate of vertical movement of said body member within said predetermined period of time.

3. The control system defined in claim 1 wherein said controller selects a "trotting" sound based upon a second predetermined rate of vertical movement of said body member within said predetermined period of time.

4. The control system defined in claim 1 wherein said controller selects a "cantering" sound based upon a third predetermined rate of vertical movement of said body member within said predetermined period of time.

5. The control system defined in claim 1 wherein said controller selects a "galloping" sound based upon a fourth predetermined rate of vertical movement of said body member within said predetermined period of time.

6. The control system defined in claim 1 wherein said controller selects a "faster galloping" sound based upon a fifth predetermined rate of vertical movement of said body member within said predetermined period of time.

7. The control system defined in claim 1 wherein said controller selects a "neighing" sound based upon a predetermined pitch change movement.

8. The control system defined in claim 1 including at least one light positioned on said toy and coupled to said controller, said controller being operable to output a signal to said at least one light to flash said light when a certain animal sound is played by said audio system based upon a predetermined rate of vertical movement of said body member received from said accelerometer.

9. The control system defined in claim 1 including an audible message delivery system housed within said toy, said message delivery system including an activation switch accessible from the exterior of said toy for playing a message previously recorded thereon.

10. The control system defined in claim 9 wherein said message delivery system is removably housed within said toy and includes a recording mode switch for re-recording a new message on said message delivery system for playing upon activation of said activation switch.

11. The control system defined in claim 9 wherein the audible message on said message delivery system is selected from the group consisting of an educational message, music, a bible story, a prayer, a bedtime story, a personalized message, a nursery rhyme, and a holiday greeting.

12. The control system defined in claim 1 wherein said accelerometer is positioned and located in the vicinity of the upper portion of said body member.

13. The control system defined in claim 1 wherein said accelerometer is positioned and located in the vicinity of the lower portion of said body member.

14. The control system defined in claim 1 including at least one speaker coupled to said audio system.

15. A riding toy for attaching to the upper leg portion of a person or for use by positioning the toy on a substantially flat supporting surface, said toy comprising:

a body member fashioned to simulate the appearance of an animal, said body member having opposed front and rear end portions, a middle portion located therebetween, spaced upper and lower portions, and a neck and head portion extending from the front end portion thereof, said body member being made of a compressible resilient material so as to conform to the upper leg portion of a person;

strap means extending from said body member for attaching to the upper leg portion of a person; and a control system for providing realistic sounds under certain riding conditions when a child is seated on said body member, said control system including:

an accelerometer positioned and located within said body member for sensing the rate of reciprocating motion of a child on said body member within a predetermined period of time;

said accelerometer being coupled to said neck portion for sensing changes in pitch movement of said neck portion when a pulling force is exerted thereagainst;

memory for storing a plurality of different animal sounds;

an audio system for playing sound; and an electronic controller coupled to said accelerometer, to said memory, and to said audio system, said controller being operable to receive a signal from said accelerometer, indicative of the rate of reciprocating motion of a child on said body member within a predetermined period of time, and said controller being operable to output a signal to said memory to select a different animal sound based upon a plurality of different predetermined rates of reciprocating motion of a child on said body member within said predetermined period of time, and to output a signal to said audio system to play a the selected animal sound based upon the signal received from said accelerometer;

said controller being further operable to receive a signal from said accelerometer indicative of the changes in pitch movement of said neck portion and outputting a signal to said memory and to said audio system to select and play a certain animal sound based upon the signal received from said accelerometer;

at least one light positioned and located on said toy and coupled to said controller, said controller being operable to output a signal to said at least one light to flash said light when a certain animal sound is played by said audio system; and an audible message delivery system housed within said toy, said message delivery system including an activation switch accessible from the exterior of said toy for playing a message previously recorded thereon.

16. The riding toy defined in claim 15 wherein the audible message on said message delivery system is selected from the group consisting of an educational message, music, a bible story, a prayer, a bedtime story, a personalized message, a nursery rhyme, and a holiday greeting.

17. The riding toy defined in claim 15 wherein said strap means are detachable and re-attachable to said body member.

18. The riding toy defined in claim 15 wherein said toy is fashioned to have the appearance of a horse.

19. A control system for providing sounds under certain riding conditions for a child's riding toy wherein the toy is a three-dimensional representation of a portion of an animal body upon which a child can be seated, the three-dimensional representation including a body member having opposed front and rear end portions, a middle portions located therebetween, spaced apart upper and lower portions, and a neck and head portion extending from the front end portion of the body member, said body member being both attachable to the upper portion of a person's leg and rentable on a supporting surface, and at least the lower portion of said body member being made of a compressible, resilient material so as to conform to the shape of the upper portion of a person's leg, the control system comprising:

a first accelerometer positioned and located within said body member, said accelerometer sensing the rate of vertical movement of said body member due to the reciprocating motion of a child on said body member within a predetermined period of time;

a second accelerometer positioned and located in the vicinity of said neck and head portion for sensing any changes in pitch movement of said neck portion when a pulling force is exerted thereagainst;

memory for storing a plurality of different animal sounds;

an audio system for playing sound; and an electronic controller coupled to said first and second accelerometers, to said memory, and to said audio system, said controller being operable to receive a signal from said first accelerometer indicative of the rate of vertical movement of said body member within said predetermined period of time, said controller being operable to output a signal to said memory to select an animal sound based upon the rate of vertical movement of said body member within said predetermined period of time, different animal sounds being selected for different rates of vertical movement within said predetermined period of time, and to output a signal to said audio system to play the selected animal sound based upon the signal received from said first accelerometer; and said controller being further operable to receive a signal from said second accelerometer indicative of the changes in pitch movement of said neck portion and to output a signal to said memory and to said audio system to select and play a certain animal sound based upon the signal received from said second accelerometer;

at least one light positioned and located on said toy and coupled to said controller, said controller being operable to output a signal to said at least one light to flash said light when a certain animal sound is played by said audio system; and an audible message delivery system housed within said toy, said message delivery system including an activation switch accessible from the exterior of said toy for playing a message previously recorded thereon.

* * * * *